US007150363B2

(12) United States Patent
Tomonari et al.

(10) Patent No.: US 7,150,363 B2
(45) Date of Patent: Dec. 19, 2006

(54) BASE STRUCTURE OF A RETAINER FOR A SHELVING

(75) Inventors: Nobuyuki Tomonari, Tokyo (JP); Kenji Kosugi, Tokyo (JP)

(73) Assignee: Tamatoshi Co., Ltd., Tokyo (JP)

( * ) Notice: Subject to any disclaimer, the term of this patent is extended or adjusted under 35 U.S.C. 154(b) by 221 days.

(21) Appl. No.: 10/860,538

(22) Filed: Jun. 3, 2004

(65) Prior Publication Data

US 2004/0262249 A1 Dec. 30, 2004

(30) Foreign Application Priority Data

Jun. 27, 2003 (JP) ..... P2003-184277

(51) Int. Cl.
*A47F 5/08* (2006.01)

(52) U.S. Cl. ..... 211/90.02; 211/175; 211/183

(58) Field of Classification Search ..... 211/175, 211/207, 196, 187, 105.3, 105.6, 90.02, 90.01, 211/105.5; 135/39, 40; 248/158, 407, 408, 248/410, 354.1, 354.5, 159, 354.6, 354.7; 403/49, 408.1; 182/186.8, 179.1, 178.1, 182/178.5

See application file for complete search history.

(56) References Cited

U.S. PATENT DOCUMENTS 356,074 A * 1/1887 Luther ..... 248/397
511,262 A * 12/1893 Bobrick ..... 248/407
2,388,056 A * 10/1945 Hendricks ..... 139/384 B
5,044,508 A 9/1991 Walter
6,591,996 B1 * 7/2003 Wu ..... 211/90.02

FOREIGN PATENT DOCUMENTS

| | | |
|---|---|---|
| CH | 168 984 | 5/1934 |
| EP | 1 312 287 | 5/2003 |
| GB | 2 125 511 | 3/1984 |
| JP | A 9-189094 | 7/1997 |

* cited by examiner

*Primary Examiner*—Jennifer E. Novosad
(74) *Attorney, Agent, or Firm*—Sturm & Fix LLP

(57) ABSTRACT

A base structure of a retainer for a shelving comprising operation section supporters (2) which have plural locking sections (5) formed at prescribed intervals on flat surfaces of a flat and vertically long board-like material and a pair of shelf board supporting members (3) which are in engagement with the operation section supporters (2), slidable in the vertical direction and provided with movable locking pieces (11) removably engaged with the locking sections (5) of the operation section supporters (2), wherein the movable locking pieces 11 are automatically engaged with or removed from the locking sections (5).

4 Claims, 5 Drawing Sheets

BASE STRUCTURE OF A RETAINER FOR A SHELVING

CROSSREFERENCE TO RELATED APPLICATIONS

This application is based upon and claims the benefit of priority from the prior Japanese Patent Application No. 2003-184277, filed Jun. 27, 2003, the entire contents of which are incorporated herein by reference.

BACKGROUND

1. Field of the Invention

The present invention relates to a base structure of a retainer for shelving for displaying commodities on a wall surface in department stores and other stores.

2. Description of the Related Art

For example, in order to display commodities or the like on a wall surface as shown in FIGS. 5 and 6, a conventional shelf board retainer has a wide board-like operating section supporter 32, which has plural hook-like grooves 31 formed in a horizontal direction, attached to the wall surface, and a shelf board supporting member having a hook-like latching part 33 in a shape capable of being latched to the hook-like grooves 31 is latched to a prescribed position in the horizontal direction of the hook-like grooves 31 at an appropriate height of the operating section supporter 32.

As shown in FIG. 7, a conventional shelf board retainer includes one which engages a shelf board supporting member 43 having a hook-like latching part 44 with a latching hole 42 of an operating section supporter on which the latching hole 42 is formed in plural positions in a vertical direction of a columnar body.

However, the above-described conventional retainer for a shelving or the like has disadvantages that it is poor in slidability and cannot be easily engaged with or removed from the groove.

Therefore, the present invention is unique and different in structure from the above-described conventional retainers and provides a base structure of a retainer which allows easy and quick engagement or removal of the sliding member and a change in position of the shelf board.

BRIEF SUMMARY OF THE INVENTION

The present invention is a base structure of a retainer for a shelving, an arm-like hanger or a hook display fitting of a shelf for displaying commodities on a wall surface, comprising an operation section supporter which has plural locking sections formed at prescribed intervals on flat surfaces of a flat and vertically long board-like material; a shelf board supporting member which has an engagement recess for slidable engagement with the operation section supporter formed and is provided with an engagement boss having a support arm projected from its front and a guide boss which is extended downward from the engagement boss; and a pair of movable locking pieces which are disposed within the engagement boss, opened and closed by the elastic force of elastic bodies with the top ends as the center of turning and to have the bottom ends projected into the engagement recess, wherein the shelf board supporting member is slidable in the vertical direction in engagement with the operation section supporter, and the movable locking pieces are detachable to the locking sections of the operation section supporter.

According to this base structure of a retainer for shelving, the movable locking pieces can be quickly and easily locked in or released from the locking section in an appropriate position by vertically moving the shelf board supporting member in engagement with the operation section supporter by means of the operation section supporter which has the plural locking sections formed at prescribed intervals on the flat surfaces of the flat and vertically long board-like material and the shelf board supporting member which has the engagement recess formed in a shape capable of engaging with the operation section supporter. When the shelf board supporting member reaches the locking section of the operation section supporter, the movable locking pieces are opened by the elastic force of the elastic bodies to project into the engagement recess, and their ends are locked by the locking sections of the operation section supporter.

When the shelf board supporting member is removed from the operation section supporter, the movable locking pieces are automatically projected into the engagement recess by the elastic force of the elastic bodies. However, when the shelf board supporting member is to be attached to the operation section supporter, the engagement recess of the shelf board supporting member is pushed to the arc surface of the operation section supporter, so that the movable locking pieces are pushed against the arc surface and can be automatically pushed into housing spaces to allow engagement.

The base structure of a retainer for a shelving according to the present invention has a housing space for housing the movable locking pieces formed in both inside wall surfaces of the engagement recess of the engagement boss.

According to this base structure of a retainer for a shelving, the housing space for the movable locking pieces is formed in both the inside wall surfaces of the engagement recess of the engagement boss, and the shelf board supporting member can be attached to the operation section supporter and moved in the vertical direction because the movable locking pieces are housed into the housing spaces.

In the base structure of a retainer for a shelving according to the present invention, the locking sections of the operation section supporter have a locking recess formed to mutually oppose in plural positions of two parallel flat surfaces in the vertical direction, and locking-seating surfaces are disposed in the engagement recess to lock the projected end faces of the movable locking pieces of the shelf board supporting member are opened.

According to this base structure of a retainer for a shelving, the locking-seating surfaces for locking the projected end surfaces when the movable locking pieces of the shelf board supporting member are opened are disposed in the locking recesses which are formed to oppose in both the parallel planes of the operation section supporter, so that the movable locking pieces are locked by the locking-seating surfaces immediately when they are opened and entered into the locking recesses. And, the shelf board supporting member locked in the locking section can be slid upward when simply moved upward because the movable locking pieces are pushed to the inclined planes of the locking recesses, moved backward and pushed into the housing spaces, and the shelf board supporting member can also be removed easily from the operation section supporter because it is released from the locked state.

According to the base structure of a retainer for a shelving of the present invention, a male arc sliding surface is formed on the side part of the top end of each of the pair of movable locking pieces disposed in the engagement boss of the shelf board supporting member, a female arc sliding surface is formed on the side of the engagement boss opposite to the male arc sliding surface, and a turning section is disposed to execute an opening or closing operation with both the arc sliding surfaces engaged and slid.

According to the base structure of a retainer for a shelving, the male arc sliding surface is formed on the side part of the top end of each of the movable locking pieces disposed in the engagement boss of the shelf board supporting member, and the female arc sliding surface is formed on the engagement boss side opposite to the male arc sliding surface, so that the movable locking pieces can be opened or closed smoothly by engaging the male arc sliding surface and the female arc sliding surface and mutually sliding them.

In the base structure of a retainer for a shelving according to the invention, a male arc surface is formed on the top ends of the movable locking pieces, a female arc surface is formed on ceiling potions, which are opposed to the top ends of the movable locking pieces, of the housing spaces in the engagement boss, and the movable locking pieces are opened or closed with both the arc surfaces engaged and slid.

According to this base structure of a retainer for a shelving, the shelf board supporting member, which has the projected end faces of the movable locking pieces locked by the locking-seating surfaces of the operation section supporter, securely supports a shelf load because the male arc surface on the top end of each of the movable locking pieces is contacted to the female arc surface on the ceiling potion, which is opposed to the top end of the movable locking piece, of the housing space in the engagement boss, the both side surfaces of the movable locking pieces are also restrained by both side walls of the housing space and both inside side surfaces of the locking recess of the operation section supporter, and the back end surface of the engagement recess of the engagement boss and the guide boss comes into contact with the arc surface of the operation section supporter.

In the base structure of a retainer for a shelving of the invention, the elastic body is comprised of a spring material, so that the elastic force required for opening or closing can be obtained securely, and the construction of the shelf board supporting member can be simplified.

BRIEF DESCRIPTION OF THE DRAWINGS

The present invention will be described with reference to the drawings, which are provided for illustration only and do not limit the invention in any respect.

DETAILED DESCRIPTION OF THE INVENTION

An embodiment of the invention will be described with reference to the accompanying drawings.

Figure 1:
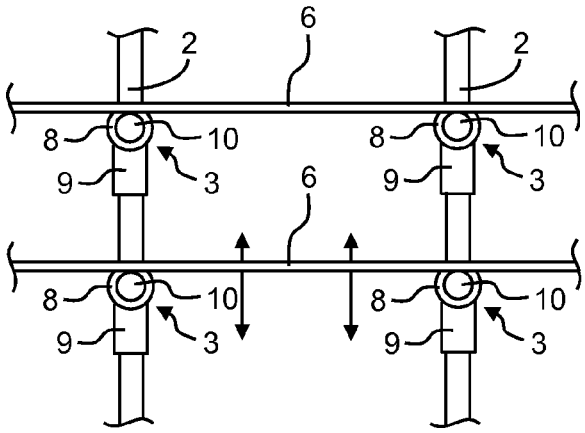
FIG. 1 is a front elevational view of a base structure of a retainer for a shelving according to an embodiment of the invention.
Figure 2:
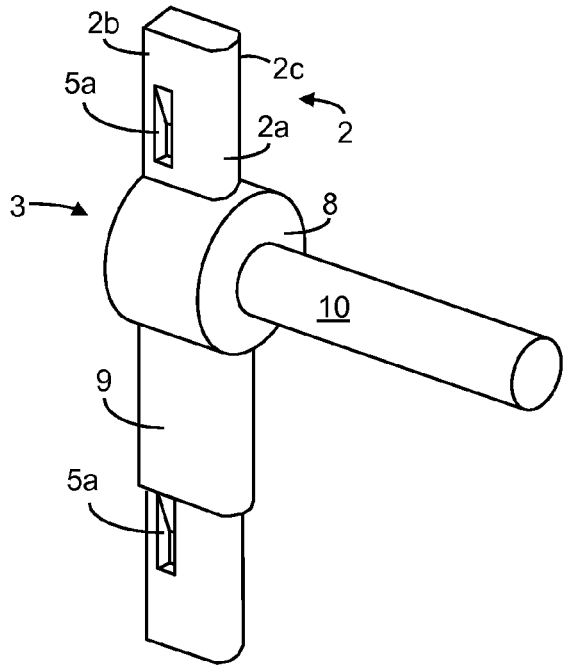
FIG. 2 is a perspective view of a shelf bracket assembly engaged to a vertical support.
Figure 3:
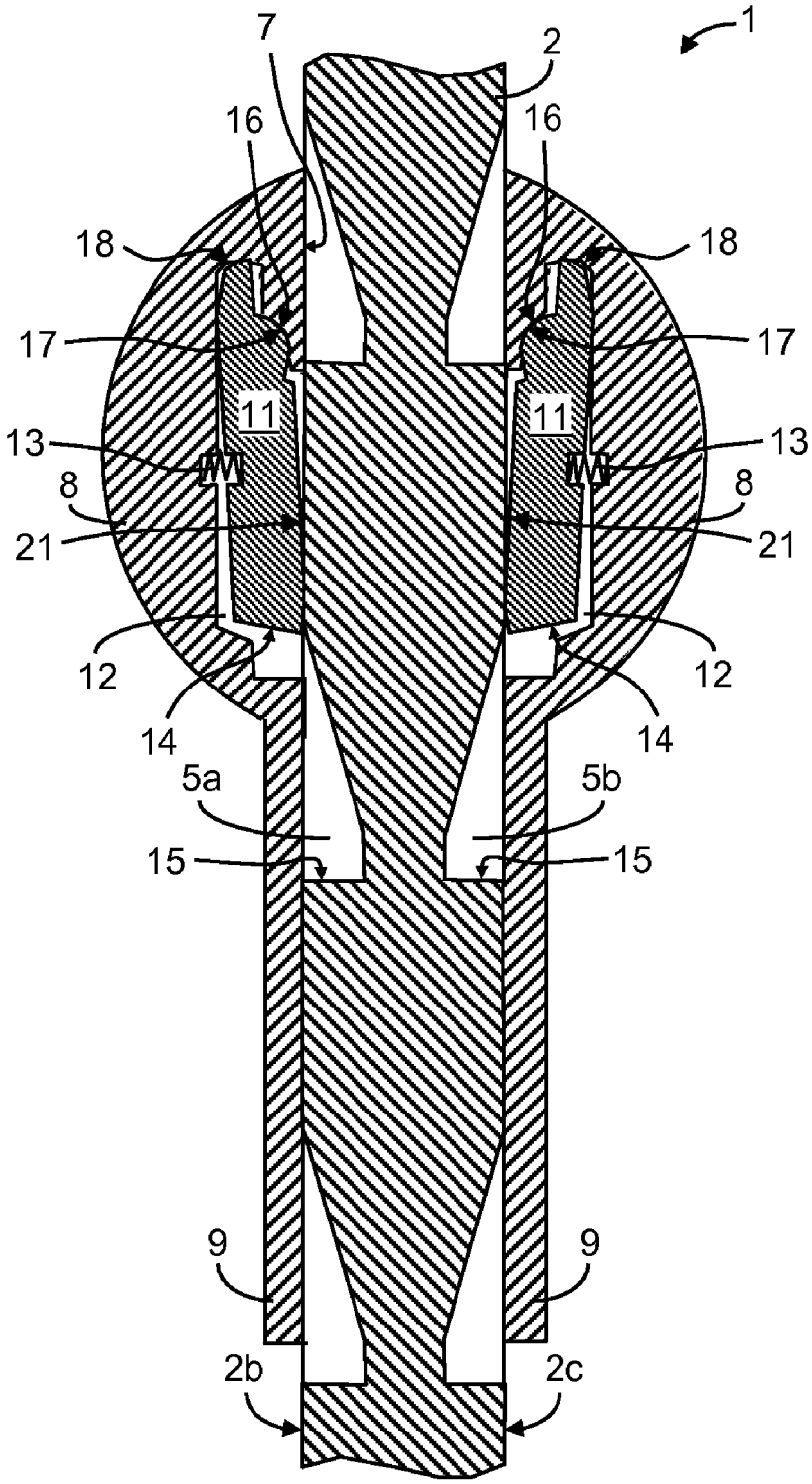
FIG. 3 is a sectional view showing a housed state of movable locking pieces in an engagement recess of the shelf bracket assembly.
Figure 4:
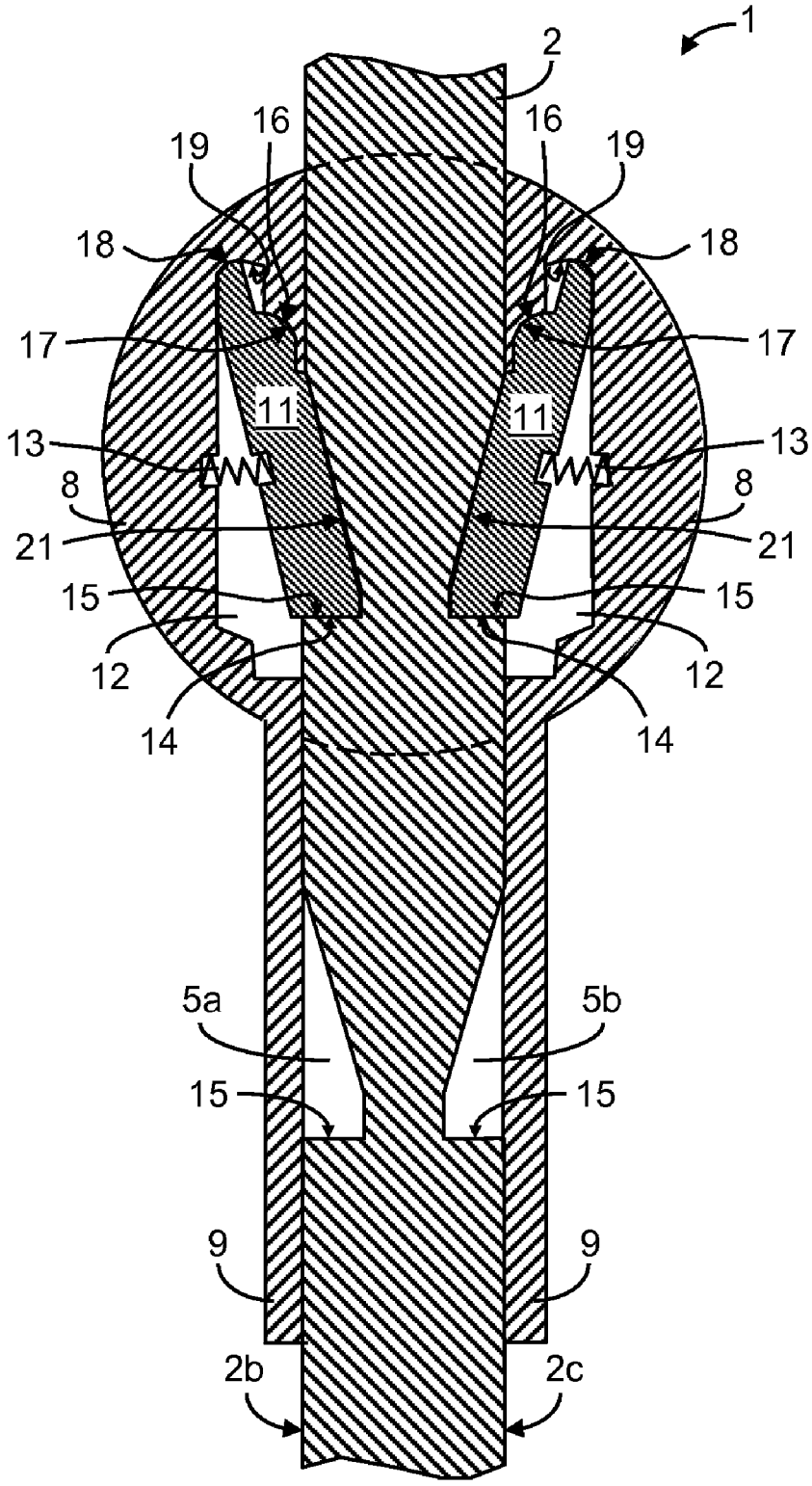
FIG. 4 is a sectional view showing a locked state of the movable locking pieces.
Figure 5:
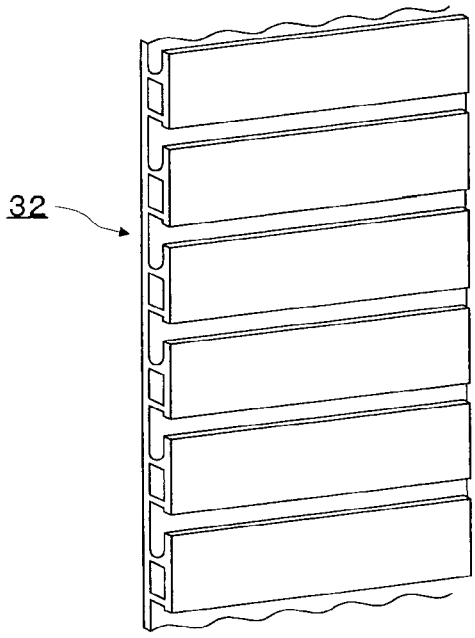
FIG. 5 (Prior Art)
FIG. 5 is an perspective view of a base structure of a conventional retainer for a shelf board or the like as found in the prior art.
Figure 6:
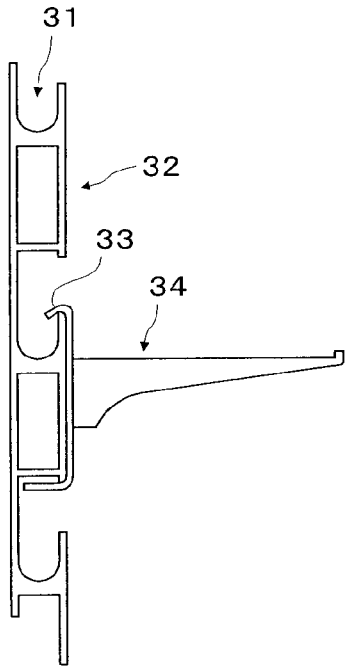
FIG. 6 (Prior Art)
FIG. 6 is an side elevational view of the base structure of the conventional retainer for a shelf board or the like as found in the prior art.
Figure 7:
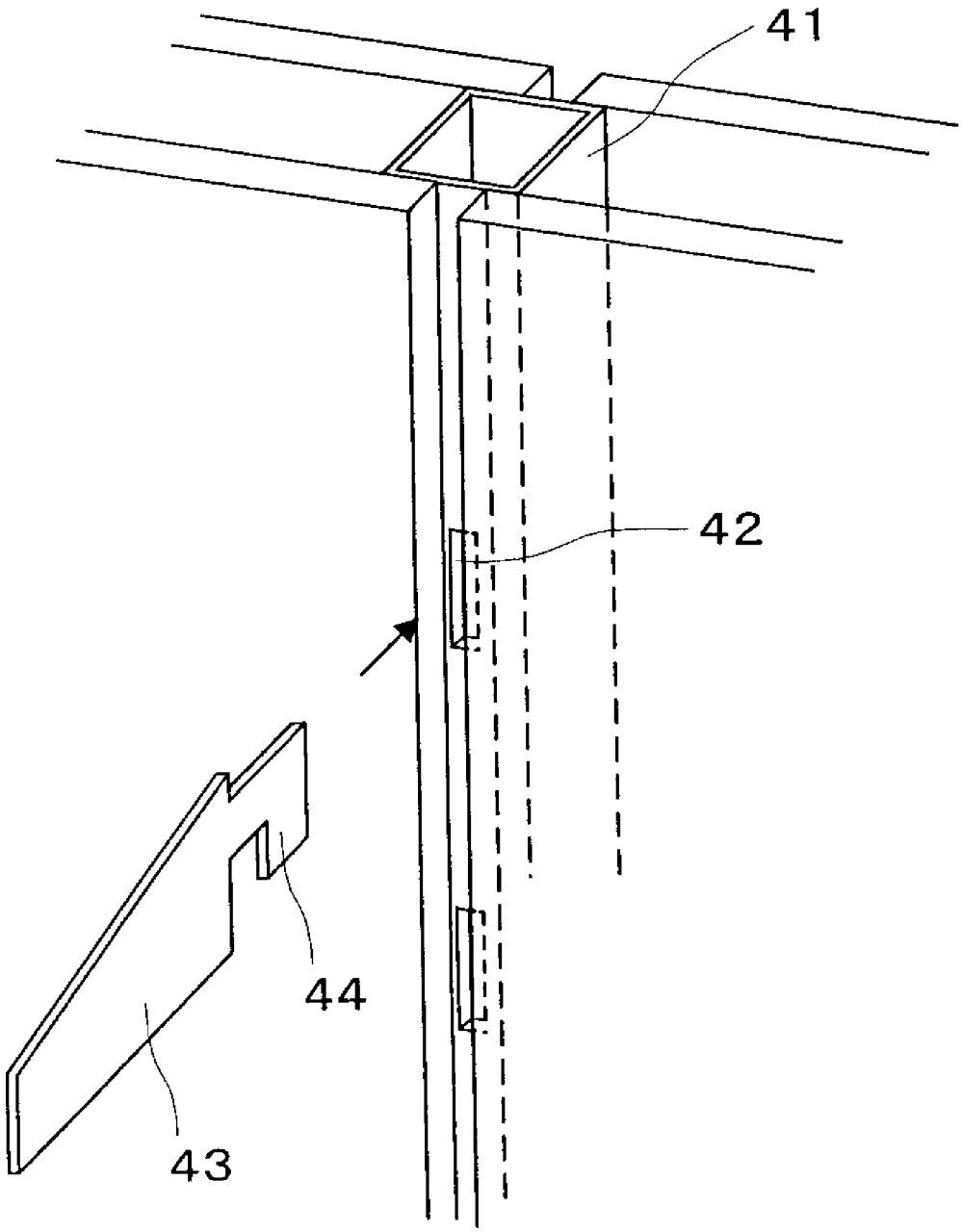
FIG. 7 (Prior Art)
FIG. 7 is an perspective view of a base structure of a conventional retainer for a shelf board or the like as found in the prior art.

FIG. 1 to FIG. 4 are pertinent to the embodiment of the invention. FIG. 1 is a drawing showing a schematic structure of a base structure of a retainer for a shelf board or the like, FIG. 2 is a perspective view showing a state that a shelf board supporting member is engaged with an operation section supporter, FIG. 3 is a sectional view showing a housed state of movable locking pieces, and FIG. 4 is a sectional view showing a locked state of the movable locking pieces.

A base structure 1 of a retainer for a shelf board 6 for displaying commodities on a wall surface in department stores and other stores. As shown in FIGS. 1 and 2, the base structure 1 of the retainer for a shelving comprises a pair of operation section supporters 2 which have locking sections 5 disposed vertically along columnar bodies at plural positions in the vertical direction and shelf board supporting members 3 which are engaged with and slidable along the operation section supporters 2 in the vertical direction and removably fitted to the locking sections 5 at appropriate positions.

As shown in FIG. 2, the operation section supporter 2 has an arc surface 2*a* formed on one surface in a longitudinal direction and locking recesses 5*a*, 5*b* (see also FIGS. 3 and 4) formed to oppose each other as the locking sections 5 in plural positions in the vertical direction of two parallel planes 2*b*, 2*c* ranging from the arc surface 2*a*. It is determined in the present invention that the plural locking sections 5 in the vertical direction have an interval of 25 mm among them.

As shown in FIG. 2, the shelf board supporting member 3 comprises an engagement boss 8, a guide boss 9 which is continuously disposed below the engagement boss 8 and a shelf board support arm 10 which is projected forward from the engagement boss 8. The engagement boss 8 is formed to have an engagement recess 7 so to be slidable in the vertical direction in engagement with the arc surface 2*a* of the operation section supporter 2 and the parallel planes 2*b*, 2*c* continuous from the arc surface 2*a*. As shown in FIG. 3, a housing space 12 for housing a movable locking piece 11 is formed in both inside surfaces of the engagement recess 7 of the engagement boss 8.

The movable locking pieces 11 to be housed in the housing spaces 12 are configured to have their bottom ends opened inward and closed with their top ends as the center of turning by elastic bodies, namely the elastic force of springs 13, so to be projectable into the locking recesses 5*a*, 5*b* of the operation section supporter 2 (see FIG. 4).

Meanwhile, locking-seating surfaces 15 for locking projected end faces 14 of projected ends, which are projected when the movable locking pieces 11 are opened, are formed in the locking recesses 5*a*, 5*b* formed in the operation section supporter 2.

Each of the movable locking pieces 11 which is disposed in the engagement boss 8 of the shelf board supporting member 3 has a male arc sliding surface 16 formed on the side part of its top end, and a female arc sliding surface 17 is formed on the side of the engagement boss 8 opposite to the male arc sliding surface 16. It is configured in such a way that the male arc sliding surface 16 and the female arc sliding surface 17 are engaged and mutually slid to perform a smooth opening or closing operation.

A male arc surface 18 is formed on the top ends of the movable locking pieces 11, and a female arc surface 19 is formed on ceiling potions, which are opposed to the top ends of the movable locking pieces 11, of the housing spaces 12 in the engagement boss 8. The male arc surface 18 and the female arc surface 19 are configured to engage and slide mutually while receiving a shelf load. Besides, the movable locking pieces 11 each have the front and back surfaces restrained by both side walls of the housing spaces 12 and both inside walls of the locking recesses 5*a*, 5*b* of the operation section supporter 2. The rear end surface of the engagement recess 7 of the engagement boss 8 and the guide boss 9 continuously disposed below the engagement boss 8 is contacted to the arc surface 2*a* of the operation section supporter 2 to securely support a shelf load.

The operation of the base structure of the above-configured retainer for a shelf board or the like will be described.

The movable locking pieces 11 of the shelf board supporting member 3 are projected into the engagement recess 7 of the engagement boss 8 by the elastic force of the springs 13 before the shelf board supporting member 3 is attached to the operation section supporter 2. When the engagement recess 7 is pushed to the arc surface 2*a* of the operation section supporter 2 with the shelf board supporting member 3 in the above-described state, the movable locking pieces 11 are contacted to and pushed against the arc surface 2*a* so to be housed in the housing spaces 12. Thus, the shelf board supporting member 3 can be attached to the operation section supporter 2. When the engaged position of the shelf board supporting member 3 is other than the locking section 5 of the operation section supporter 2, namely a land section 20, as shown in FIG. 3, the movable locking pieces 11 are housed in the housing spaces 12, so that the shelf board supporting member 3 can be moved vertically as it is to a prescribed distance and can also be pulled out as it is from the operation section supporter 2. When the shelf board supporting member 3 is moved from the above engaged position to the locking section 5, the movable locking pieces 11 are automatically opened by the elastic force of the springs 13 to enter their ends into the locking recesses 5*a*, 5*b*, and their projected end faces 14 are locked by the locking-seating surfaces 15 as shown in FIG. 4. Thus, the attachment is completed.

To remove the attached shelf board supporting member 3 from the operation section supporter 2, the shelf board supporting member 3 is moved upward from the locked state shown in FIG. 4, and the movable locking pieces 11 are pushed to inclined planes 21 which are formed in the locking recesses 5*a*, 5*b* of the operation section supporters 2, moved backward to move onto the land sections 20 of the operation section supporter 2 and housed into the housing spaces 12 as shown in FIG. 3. Thus, the movable locking pieces 11 are released, and the shelf board supporting member 3 can be pulled out as it is.

As described above, according to the base structure of a retainer of a shelving, the operation section supporter is a vertically long columnar body and has the locking sections of the locking recesses disposed in plural positions of its both surfaces in the vertical direction. Therefore, the shelf board supporting member is vertically moved in a state engaged with the operation section supporter and locked in one of the locking sections when the movable locking pieces are automatically projected upon reaching that locking section.

To remove the shelf board supporting member, its engagement can be released by simply moving the shelf board supporting member upward, so that it can be pulled out simply and quickly. Therefore, the base structure of the retainer for a shelving can be attached quickly and easily according to the request at the scene.

It is to be understood that the present invention is not limited to the specific embodiment thereof illustrated herein, and various modifications may be made without deviating from the spirit and scope of the invention.

What is claimed is:

1. A base structure of a retainer for a shelving shelf board, an arm-like hanger or a hook display fitting of a shelf for displaying commodities on a wall surface, comprising:

an operation section supporter which has plural locking sections formed at prescribed intervals on flat surfaces of a flat and vertically long board-like material;

a shelf board supporting member which has an engagement recess for slidable engagement with the operation section supporter formed and is provided with an engagement boss having a support arm projected from its front and a guide boss which is extended downward from the engagement boss; and at least one pair of movable locking pieces with an elastic body, which is disposed within the engagement boss and having a male arc sliding surface on a side part of a top end, mutually engaged with and slid on a female arc sliding surface formed on an engagement boss side opposite to the male are sliding surface to perform an opening or closing operation by the elastic force of the elastic body, and having the bottom end projected into the locking section of the operation section supporter; a pair of movable locking pieces which are disposed within the engagement boss and opened or closed by the elastic force of elastic bodies with the top ends as the center of turning and to have the bottom ends projected into the engagement recess, wherein the shelf board supporting member is slidable in the vertical direction in engagement with the operation section supporter, and the movable locking pieces are detachable to the locking sections of the operation section supporter.

2. The base structure of a retainer for a shelving according to claim 1, wherein a housing space for housing the movable locking pieces is formed in both inside wall surfaces of the engagement recess of the engagement boss.

3. The base structure of a retainer for a shelving according to claim 1, wherein the locking sections of the operation section supporter have a locking recess formed to mutually oppose in plural positions of two parallel flat surfaces in the vertical direction, and surfaces are disposed in the engagement recess to lock the projected end faces of the movable locking pieces.

4. The base structure of a retainer for a shelving according to claim 1, wherein the elastic body is comprised of a spring material, a male arc sliding surface is formed on the side part of the top end of each of the pair of movable locking pieces disposed in the engagement boss of the shelf board supporting member, a female arc sliding surface is formed on the side of the engagement boss opposite to the male arc sliding surface, and a turning section is disposed to execute an opening or closing operation with both the arc sliding surfaces engaged and slid.

* * * * *